US007454928B2

(12) United States Patent
Houser et al.

(10) Patent No.: US 7,454,928 B2
(45) Date of Patent: Nov. 25, 2008

(54) MULTI-COMPONENT ISOLATION DAMPING SYSTEM FOR A LAUNDRY WASHING MACHINE

(75) Inventors: Marvin Joseph Houser, Quincy, IL (US); Joseph A. Knopp, Batavia, IL (US); Gerard Bedard, Manchester, NH (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 600 days.

(21) Appl. No.: 10/914,321

(22) Filed: Aug. 9, 2004
(Under 37 CFR 1.47)

(65) Prior Publication Data

US 2006/0026771 A1 Feb. 9, 2006

(51) Int. Cl.
*D06F 37/20* (2006.01)

(52) U.S. Cl. ..... 68/23.1; 68/23.3; 248/638; 188/268; 267/140

(58) Field of Classification Search ..... 68/23.1, 68/23.3; 267/140
See application file for complete search history.

(56) References Cited

U.S. PATENT DOCUMENTS

| | | | | |
|---|---|---|---|---|
| 2,969,172 | A | 1/1961 | Percy | |
| 3,108,465 | A | 10/1963 | Bochan | |
| 3,197,983 | A | 8/1965 | Ilmer | |
| 3,277,742 | A | 10/1966 | Jacobsen | |
| 3,285,419 | A | 11/1966 | Smith | |
| 3,475,928 | A * | 11/1969 | Wasemann | 68/23.2 |
| 3,744,746 | A | 7/1973 | Weir et al. | |
| 3,952,557 | A | 4/1976 | Bochan | |
| 4,250,724 | A | 2/1981 | Altnau | |
| 4,468,938 | A | 9/1984 | McMillan | |
| 4,475,363 | A | 10/1984 | Thomson | |
| 4,502,303 | A | 3/1985 | Wasemann | |
| 4,729,458 | A * | 3/1988 | Bauer et al. | 188/129 |
| 5,377,508 | A | 1/1995 | Hair et al. | |
| 5,946,947 | A | 9/1999 | Lee et al. | |
| 5,950,460 | A | 9/1999 | Oh et al. | |
| 6,220,063 | B1 | 4/2001 | Wunderlich et al. | |
| 6,574,997 | B1 * | 6/2003 | Mayer et al. | 68/23.1 |
| 6,695,295 | B2 * | 2/2004 | Williams | 267/140.13 |

FOREIGN PATENT DOCUMENTS

| | | |
|---|---|---|
| DE | 4413069 | 10/1994 |
| EP | 0117824 A * | 1/1984 |
| WO | 200068488 | 11/2000 |

* cited by examiner

*Primary Examiner*—Michael Barr
*Assistant Examiner*—Jason P. Riggleman
(74) *Attorney, Agent, or Firm*—Ronald W. Wangerow; Harness, Dickey & Pierce, P.L.C.

(57) ABSTRACT

A suspension system for use in a laundry washing machine to suspend a tub assembly from a base portion of a cabinet. The suspension system includes a support frame interconnected to an outer tub of the tub assembly and a plurality of isolation damper units for resiliently coupling the support frame to the base portion of the cabinet. The isolation damper units function to allow limited lateral movement of the tub assembly relative to the cabinet while also providing a "return to center" feature. The isolation damper units are further operable to inhibit rotation of the outer tub relative to the cabinet. Finally, the isolation damper units function to absorb the vibration transmitted through the tub assembly to the support frame so as to minimize transmission of such vibration to the cabinet.

12 Claims, 6 Drawing Sheets

MULTI-COMPONENT ISOLATION DAMPING SYSTEM FOR A LAUNDRY WASHING MACHINE

BACKGROUND OF THE INVENTION

1. Field of the Invention

The present invention relates generally to laundry washing machines and, more particularly, to a washing machine having an improved suspension system equipped with isolation damper units.

2. Description of the Prior Art

Laundry washing machines of the top-loading variety typically include a cabinet having a base, a four-sided housing secured to the base, and a top enclosure secured to the top of the housing which has a lid to provide access to a spin basket. The spin basket is rotatably mounted within an outer tub and is perforated to allow the wash water to be transferred into the outer tub during the centrifugal extraction or "spin" cycle. Such washing machines also include a drive assembly for controlling high-speed rotation of the spin basket as well as low-speed oscillatory movement of an agitator which is centrally located within the spin basket. Typically, the drive assembly includes an electric motor and a transmission that are mounted either to the cabinet base or a support structure. In turn, the support structure is mounted between the outer tub and the base of the cabinet by a suspension system that is adapted to absorb excessive vibration from unbalanced loads that may occur, for example, during the high speed spin cycle.

One example of a conventional suspension system for top-loading washing machines uses a dome-type pivot assembly between the support structure and the cabinet base that is anchored by a plurality of centering springs. The dome-type assembly typically includes a raised male dome segment centrally formed in the base and a corresponding female dome segment associated with the support structure. A low friction member, such as a plastic snubber ring, is disposed between the aligned dome segments. In some washing machines, one or both of the dome segments are coated, such as with a Teflon paint, to provide additional lubricity. The centering springs provide several functions including connecting the support structure and outer tub to the base, preventing rotation of the outer tub during the spin cycle, and allowing limited lateral movement of the outer tub while providing a means for automatically returning the outer tub to a centered position relative to the cabinet.

One particular concern with top-loading washing machines is the need to prevent excessive lateral movement of the outer tub caused by unbalanced loads of clothes in the spin basket during the spin cycle. Depending upon the amount and location of the load, it is possible to generate resonant frequencies that are capable of causing the outer tub to strike the sidewalls of the cabinet. In addition, the suspension system must also be able to accommodate rotation of the spin basket without transmitting the resultant vibration to the floor so as to prevent "walking" of the washing machine. In an attempt to address these concerns, many top-loading washing machines having the conventional spring-type suspension system are also equipped with a counterweighted ring at the top of the spin basket and/or an unbalance sensor that is operable for automatically de-energizing the drive assembly upon occurrence of an excessive out-of-balance condition. In addition, it is also conventional to install a layer of sound deadening material on the base of the cabinet to absorb a portion of the noise generated by such vibration.

In view of the above, there is a recognized need in the field of laundry washing machines to design and develop improved suspension systems that address the shortcomings of conventional spring-type systems which can be commercially produced at an economical cost.

SUMMARY OF THE INVENTION

Accordingly, it is an objective of the present invention to provide an isolation and damping suspension system for laundry washing machines which is an improvement over conventional spring-type suspension systems.

A further objective is to provide a washing machine equipped with such a suspension system having a plurality of isolation damper units resiliently coupling the outer tub and its related support structure to a base portion of the cabinet.

A related objective of the present invention is to utilize the isolation damper units in washing machines to improve the vibration isolation and damping characteristics of the suspension system.

In accordance with these and other objectives, the present invention is directed to a suspension system for use in a laundry washing machine to suspend a tub assembly from a base portion of a cabinet. The suspension system includes a support frame interconnected to an outer tub of the tub assembly and a plurality of isolation damper units for resiliently coupling the support frame to the base portion of the cabinet. The isolation damper units function to allow limited lateral movement of the tub assembly relative to the cabinet while also providing a "return to center" feature. In addition, the isolation damper units are further operable to inhibit rotation of the outer tub relative to the cabinet. Finally, the isolation damper units function to absorb the vibration transmitted through the tub assembly to the support frame so as to minimize transmission of such vibration through the cabinet to the floor. The improved vibration absorption provided by the isolation damper units also results in a reduction in the operational noise levels generated by the washing machine.

In accordance with a preferred arrangement, each isolation damper unit of the present invention includes a first attachment component adapted for connection to the support frame, a second attachment component adapted for connecting a casing to the base of the cabinet, and a resilient isolator mounted within the casing and having an aperture within which the first attachment component is retained. The aperture in the isolator is contoured to define a series of lobed projections which engage a cylindrical segment of the first attachment component. This engagement applies a compressive preload to the lobed projections for permitting the isolation damper units to provide a return-to-center feature.

In accordance with additional features associated with the isolation damper units of the present invention, the casing is configured to provide axial and radial compressive loading on the isolator. In addition, the isolator is preferably fabricated from a microcellular polyurethane material. Furthermore, when used in the suspension system of a laundry washing machine, the isolator damper units are equally-spaced and work in concert to absorb vibration and attenuate noise while damping movement of the tub assembly relative to the base of the cabinet.

BRIEF DESCRIPTION OF THE DRAWINGS

The above objectives and various preferred arrangements, as well as additional advantageous features of the present invention, will become apparent from the following description and the appended claims in view of the accompanying drawings wherein:

DETAILED DESCRIPTION OF THE PREFERRED EMBODIMENT

In general, the present invention is directed to an improved suspension system for use in laundry washing machines that provides significant advantages over conventional spring-type suspension systems. To better understand these advantages, a conventional washing machine will initially be described with reference to FIG. 1 of the drawings so as to clearly define the current state of the art.

Figure 1:
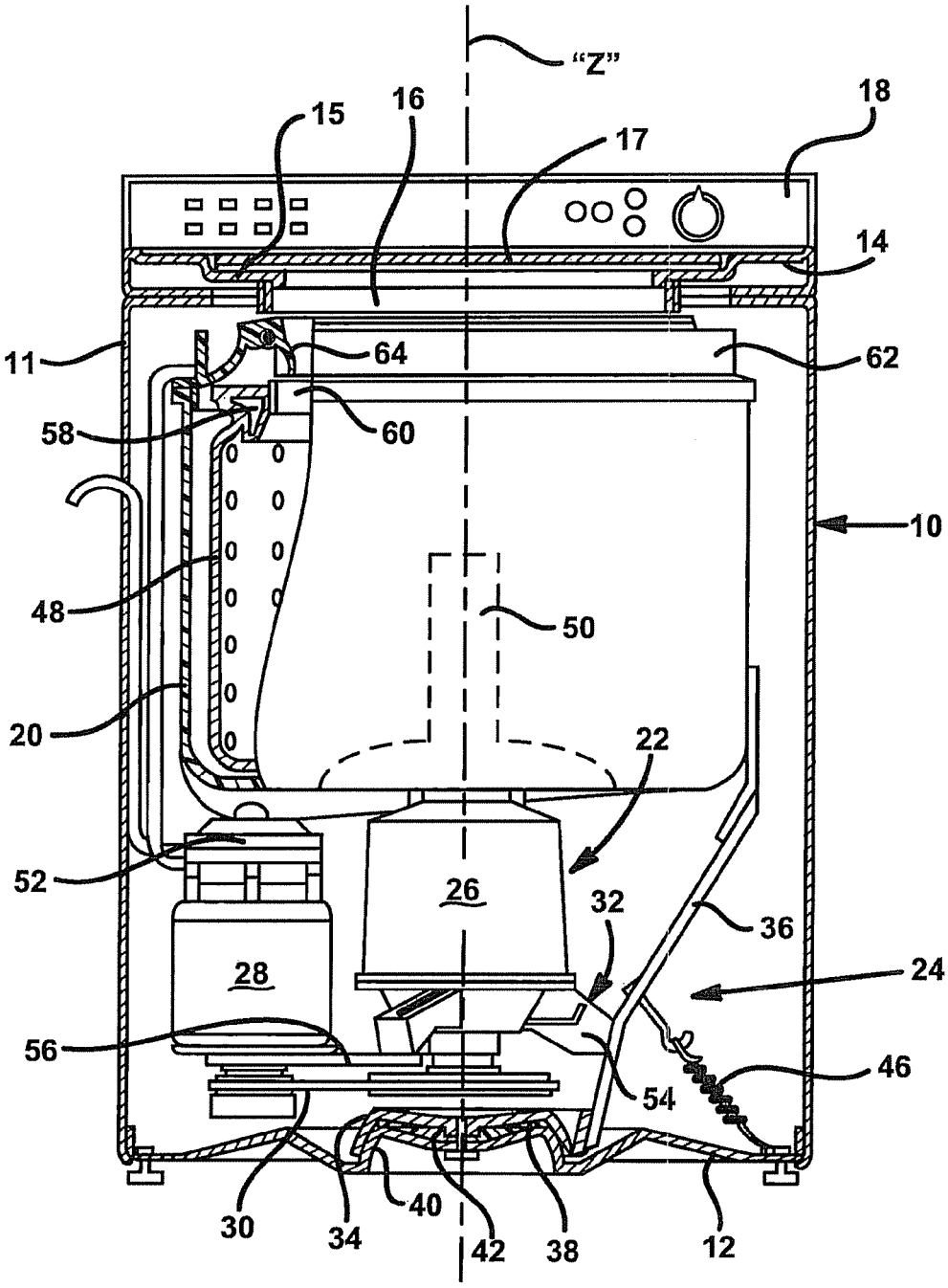
FIG. 1 PRIOR ART
FIG. 1 is an elevational view of a top-loading laundry washing machine, partially in section, showing a tub assembly mounted to a cabinet base via a conventional spring-type suspension system.

As shown in FIG. 1, a typical top-loading washing machine includes a cabinet 10 having a housing with four sidewalls 11 which extend upwardly from a base 12. A top enclosure 14 is shown to be mounted to cabinet 10 on top of sidewalls 11. Top enclosure 14 has a central recessed portion 15 which defines an access opening 16 that is covered by a hinged lid 17. A control panel 18 is mounted to top enclosure 14 and includes a plurality of control members (i.e., dials, knobs, push buttons, etc.) for permitting selection of the desired washing cycles and water temperatures in a well-known manner.

Within cabinet 10, the washing machine mechanism is shown to include a tub assembly having an outer tub 20 and a drive assembly 22 that are resiliently mounted to base 12 via a suspension system 24. Drive assembly 22 includes a transmission 26 that is centrally located below outer tub 20 and an electric motor 28 for driving transmission 26 via a drive belt 30. Suspension system 24 includes a support frame 32 having a ring member 34 and a plurality of braces 36. Braces 36 are equally spaced and have a first end rigidly secured to outer tub 20 and a second end rigidly secured to ring member 34. As seen, ring member 34 defines a recessed cup segment 38 which is aligned with a central dome 40 formed in base 12. A suitable low-friction centering member, commonly referred to as a snubber ring 42, is disposed in the annular space between cup segment 38 of ring member 34 and dome segment 40 of base 12. This ball socket type arrangement allows outer tub 20 to pivot about a vertical axis "Z" located at the center of dome segment 40 with snubber ring 42 acting to damp movement therebetween. Suspension system 24 further includes a plurality of centering springs 46 which each extend from brace 36 down to a position on the outermost edge of base 12. Centering springs 46 function to bias support frame 32 and outer tub 20 to a centered position aligned with the vertical axis while also inhibiting rotation of outer tub 20 relative to base 12. In many arrangements, at least six centering springs 46 are used to provide the requisite self-centering function.

The tub assembly of the washing machine mechanism is shown to further include a perforated spin basket 48 that is mounted inside outer tub 20 for rotation about the vertical axis and which is driven by motor 28 through transmission 26. Transmission 26 also drives an agitator 50 (shown in phantom) which extends upwardly within spin basket 48. In addition, a pump 52 is provided to control the delivery and drainage of water to and from spin basket 48 during operation of the washing machine. As seen, transmission 26 is mounted to cross brackets 54 which, in turn, are connected to braces 36 such that transmission 26 is supported by support frame 32. Likewise, motor 28 is shown to be mounted to a support plate 56 that is also part of support frame 32. A weighted balance ring 58 is attached to the open upper end of spin basket 48 such that its central aperture 60 is aligned with access opening 16 of top enclosure 14. Finally, a tub cover 62 is attached to the open upper end of outer tub 20 and has a central aperture 64 which is also aligned with access opening 16 in top enclosure 14.

Operation of the washing machine is conventional in that it functions in either a wash mode or a spin mode. In the wash mode, transmission 26 is shifted into a first stage for oscillating agitator 50 at low speeds within spin basket 48 which is filled with clothes, water, and detergent. Upon completion of the wash cycle, transmission 26 is shifted into a second stage for rotating spin basket 48 at a high speed so as to establish the spin cycle. During the spin cycle, the clothes are thrown by centrifugal force against spin basket 48 and the water drains through the perforations into outer tub 20 and is subsequently pumped out of the washing machine.

The present invention is generally directed to an improved suspension system for laundry washing machines. In particular, the improved suspension system of the present invention is well-suited for, but not limited to, use with top-loading washing machines having a construction generally similar to the washing machine shown in FIG. 1. As will be detailed, the improved suspension system of the present invention functions to eliminate the dome-type pivot arrangement and the centering springs while providing superior vibration isolation and damping characteristics.

Figure 2:
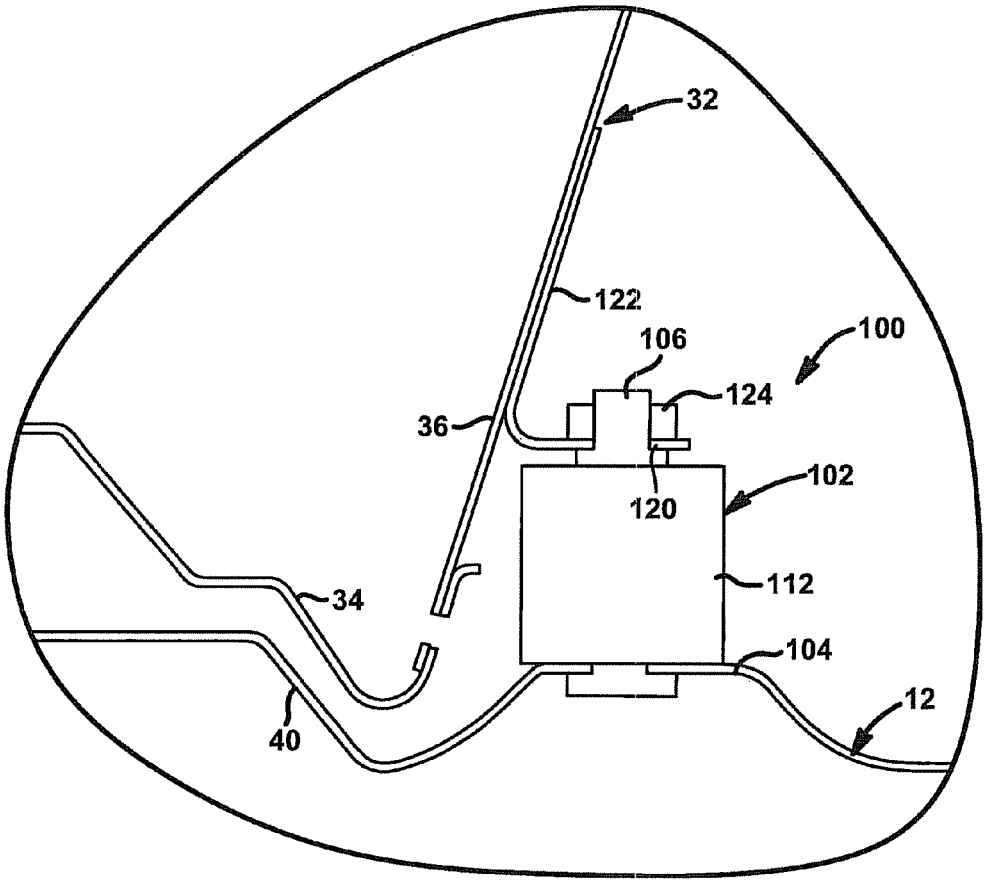
FIG. 2 is an environmental view illustrating an isolation damper unit, of the type associated with the improved suspension system of the present invention, operably installed between the cabinet base and an outer tub mounting structure.

To accomplish the objectives of the present invention, FIGS. 2 through 5 disclose an isolation and damping suspension system 100 that is applicable for use in laundry washing machines. In general, suspension system 100 can be substituted for the convention suspension system shown in FIG. 1 by eliminating snubber ring 42 and centering springs 46 and installing a plurality of isolation damper units 102 between base 12 of cabinet 10 and support frame 32. Preferably, a set of three equally-spaced isolation damper units 102 are used in association with suspension system 100. In this regard, FIG. 2 illustrates installation of one of the plurality of isolation damper units 102 between a raised annular rim portion 104 of base 12 and one of support braces 36 which, as previously noted, extends between ring member 34 and outer tub 20. The upper end of each brace 36 is either directly secured to outer tub 20 or, in the alternative, is secured to an upper plate or ring that is then secured to outer tub 20. It will be appreciated that the specific design and configuration shown for support frame 32 and base 12 are not critical to the present invention, but rather function to interconnect isolation damper units 102 between outer tub 20 and base 12. Thus, any frame or support structure or base structure which provide this function will be considered as equivalent to the particular structure shown.

According to the present invention, isolation damper units 102 each provide several integrated functions including: allowing limited lateral movement of tub 20 relative to base 12; providing a mechanism for returning tub 20 to a centered position within cabinet 10; and absorbing vibration transmitted through tub 20 and support frame 32 and/or the other components attached thereto. The integration of these functions into isolation damper units 102 results in a significant reduction in the overall cost of the suspension system by eliminating components and simplifying the assembly process. In addition, the construction of isolation damper units 102 permits use of suspension system 100 with only minor redesign of some of the components currently used in production laundry appliances.

Figure 3:
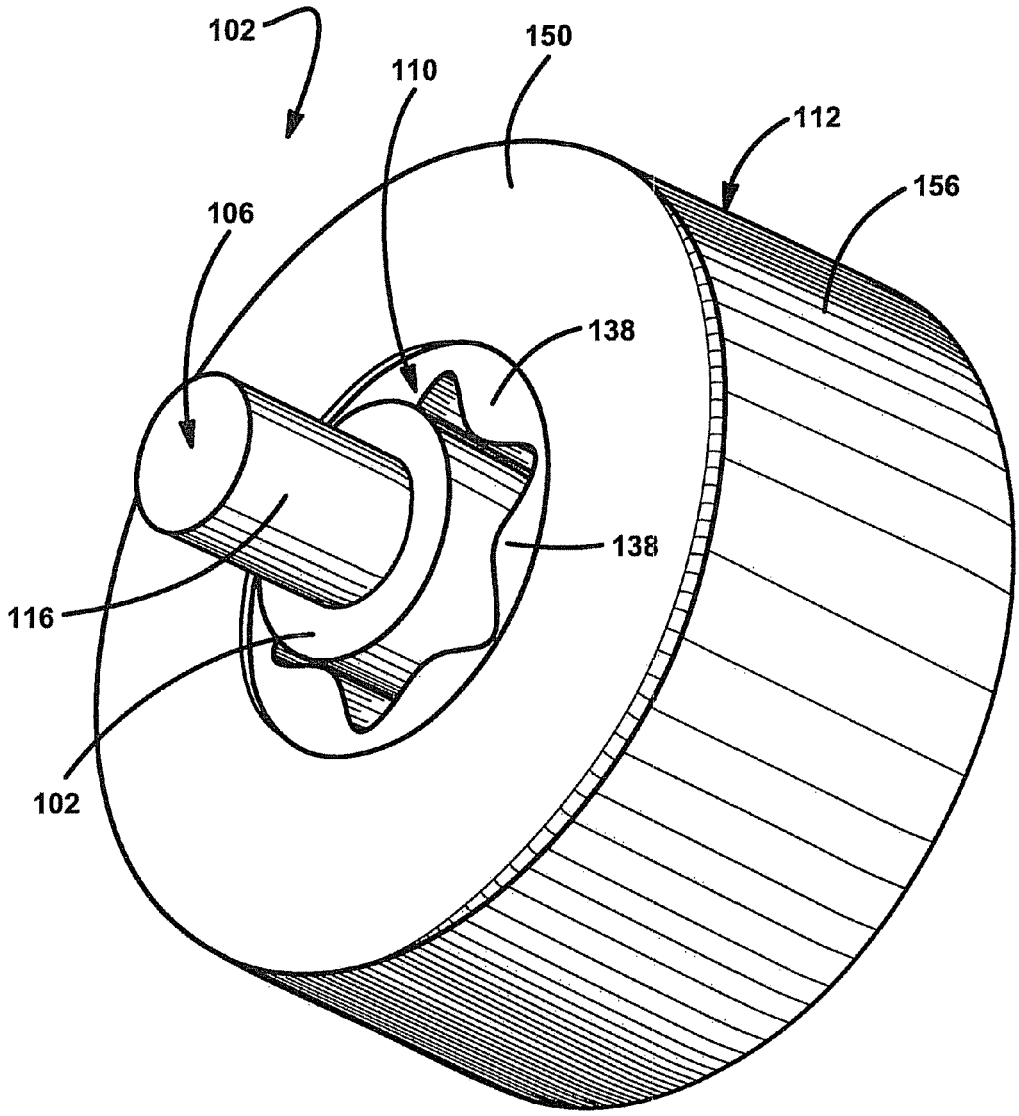
FIG. 3 is a perspective view of the isolation damper unit shown in FIG. 2.
Figure 4:
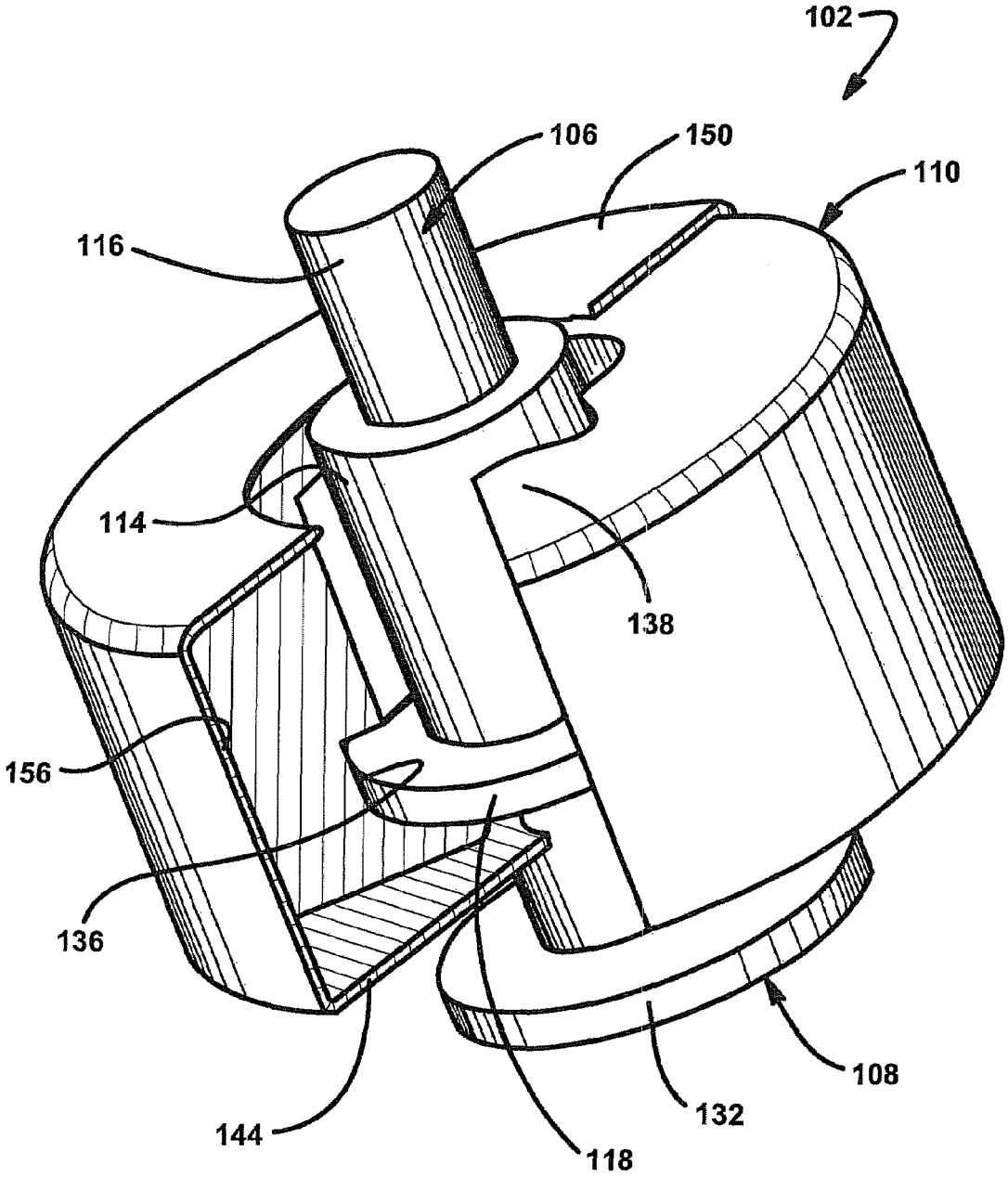
FIG. 4 is another perspective view, with some components partially shown in section, of the isolation damper unit shown in FIG. 3.
Figure 5:
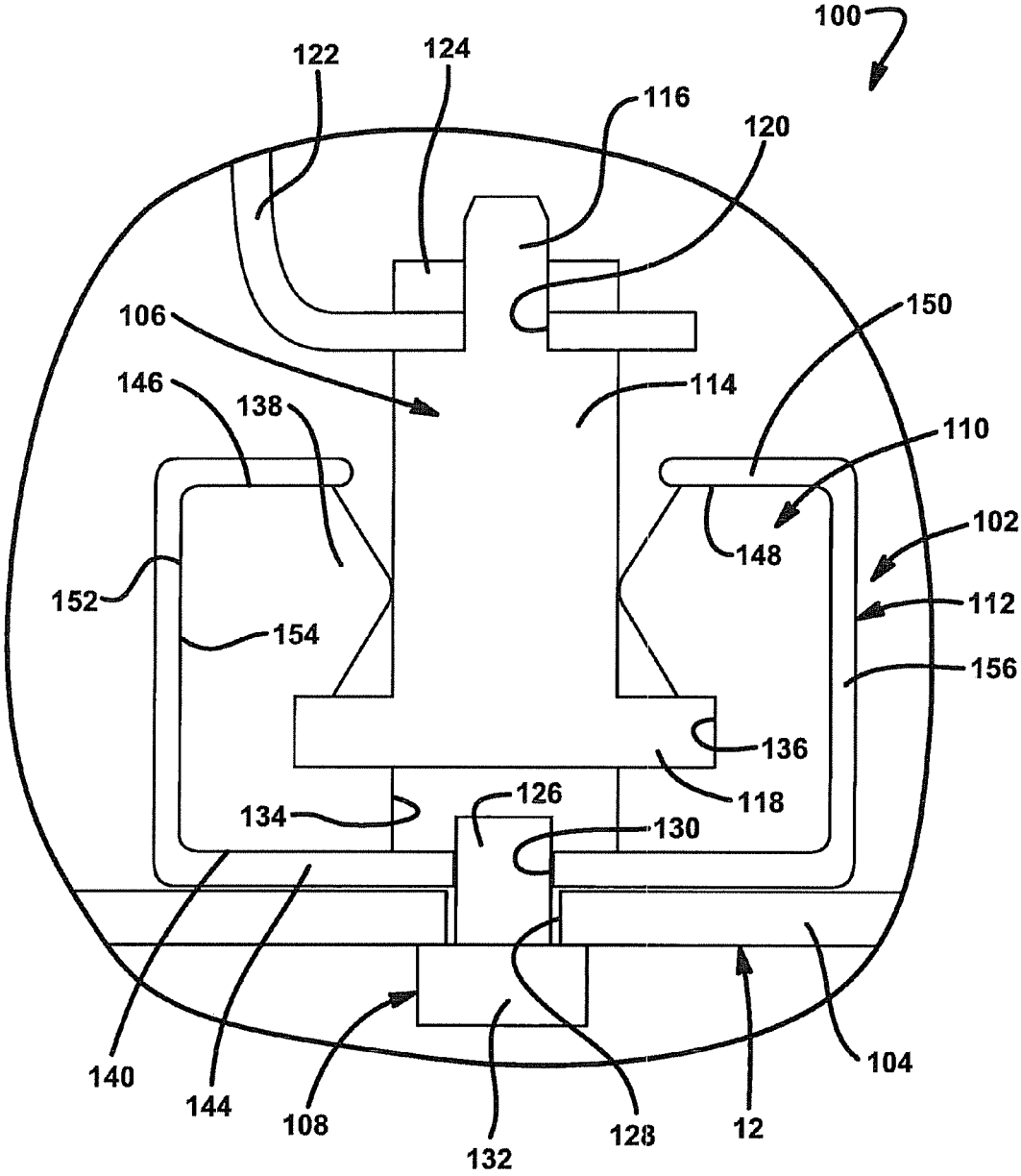
FIG. 5 is a sectional view of the isolation damper unit.

As best seen from FIGS. 3 through 5, each isolation damper unit 102 includes a first attachment component 106, and second attachment component 108, a resilient isolator 110, and a casing 112. First attachment component 106 is a shoulder bolt having a cylindrical shank segment 114 interconnecting a threaded bolt segment 116 and a radial flange segment 118. Bolt segment 116 is adapted to extend through a mounting bore 120 formed in a mounting bracket 122 that is rigidly secured to brace 36. A nut 124 releaseably secures bolt segment 116 to mounting bracket 122. Likewise, second attachment component 108 is a bolt having a threaded shank segment 126 which extends through a mounting hole 128 in base segment 104 and engages a threaded mounting bore 130 centrally formed in casing 112. Bolt 108 is threadably tightened until its head portion 132 engages base segment 104 for securely connecting casing 112 to base 12.

Isolator 110 is an annular member having a contoured central aperture 134 defining a circumferential groove 136 and a plurality of tooth-shaped lobes 138. When isolation damper unit 102 is fully assembled, radial flange segment 118 of attachment component 106 is retained in groove 136 of isolator 110 and the terminal ends of lobes 138 engage shank segment 114 of first attachment component 106. Preferably, such engagement results in a radial compressive load being applied to lobes 138 so as to inhibit rotation of isolator 110 relative casing 112 and first attachment component 106.

Preferably, isolator 110 has at least three equally-spaced lobes 138 with the specific number thereof selected based on the needs of the particular application. In addition, isolator 110 is preferably fabricated from a microcellular polyurethane (MCU) material. The MCU material is preferred since it provides several advantageous features including superior vibration isolation characteristics, mechanical durability, resistance to most environmental fluids (i.e., oil, grease, ozone, water, etc.) and its low mass. In addition, the MCU material has a wide operating temperature range and low compression set characteristics. Furthermore, the MCU material can be "tuned" by changing the material density within a common mold in order to obtain the optimal isolation properties for each specific application. However, it is to be understood that any suitable material providing the required compressibility and resiliency characteristic can be used for isolator 110 as required for each particular application. Examples of alternative materials include rubber, plastic, thermoplastics, etc. Finally, isolator 110 can be assembled from a plurality of isolator segments that are retained within casing 112.

As best seen from FIG. 5, isolator 110 is disposed in an internal chamber defined within casing 112. In particular, isolator 110 has a planar lower end surface 140 that is in engagement with a face surface 142 of a lower case segment 144 on casing 112. Likewise, isolator 110 has a planar upper end surface 146 that is in engagement with a face surface 148 of an upper case segment 150 of casing 112. Finally, an outer wall surface 152 of isolator 110 is in engagement with a cylindrical inner wall surface 154 of a rim segment 156 of casing 112. In order to achieve optimal vibration isolation, casing 112 exerts both axial and radial compression on isolator 110. Specifically, case segments 144 and 150 of casing 112 exert an axially directed compressive preload on isolator 110 while cylindrical rim segment 156 of casing 112 exerts a radially directed compressive preload on isolator 110. In this regard, wall surface 152 of isolator 110 can be cylindrical so as to be complementary to cylindrical inner wall surface 154 of casing 112 or, in the alternative, can be contoured (i.e., lobed, serrated, threaded, etc.) to define a number of distinct lines of contact with inner wall surface 154. Casing 112 is preferably fabricated from a stamped metal component. However, it is contemplated that casing 112 could also be constructed from a number of interconnect case components.

Isolator 110 performs a number of functions within isolation damper units 102. In particular, the axial and radial compression of isolator 110 within casing 112 provides for vibration isolation and inhibits rotation of outer tub 20 (via its connection to support frame 32) relative to base 12. In addition, the lobed configuration of aperture 134 permits lateral movement while also providing a return-to-center function since a compressed lobe 138 will "push back", thereby forcing support frame 38 and tub 20 to return to its centered position relative to cabinet 10. In particular, when a side-impacting force is exerted by the tub assembly through support frame 20 on isolation damper units 102, the energy will cause some amount of lateral motion. A portion of this energy is absorbed due to compression of isolator 110 while the remaining energy results in deflection of isolator 110. The compressed isolator 110 exerts an equal and opposite reaction force which will act to return each isolation damper unit 102 to its original unloaded position, thereby returning outer tub 20 to its centered position along the "Z" axis.

Figure 6:
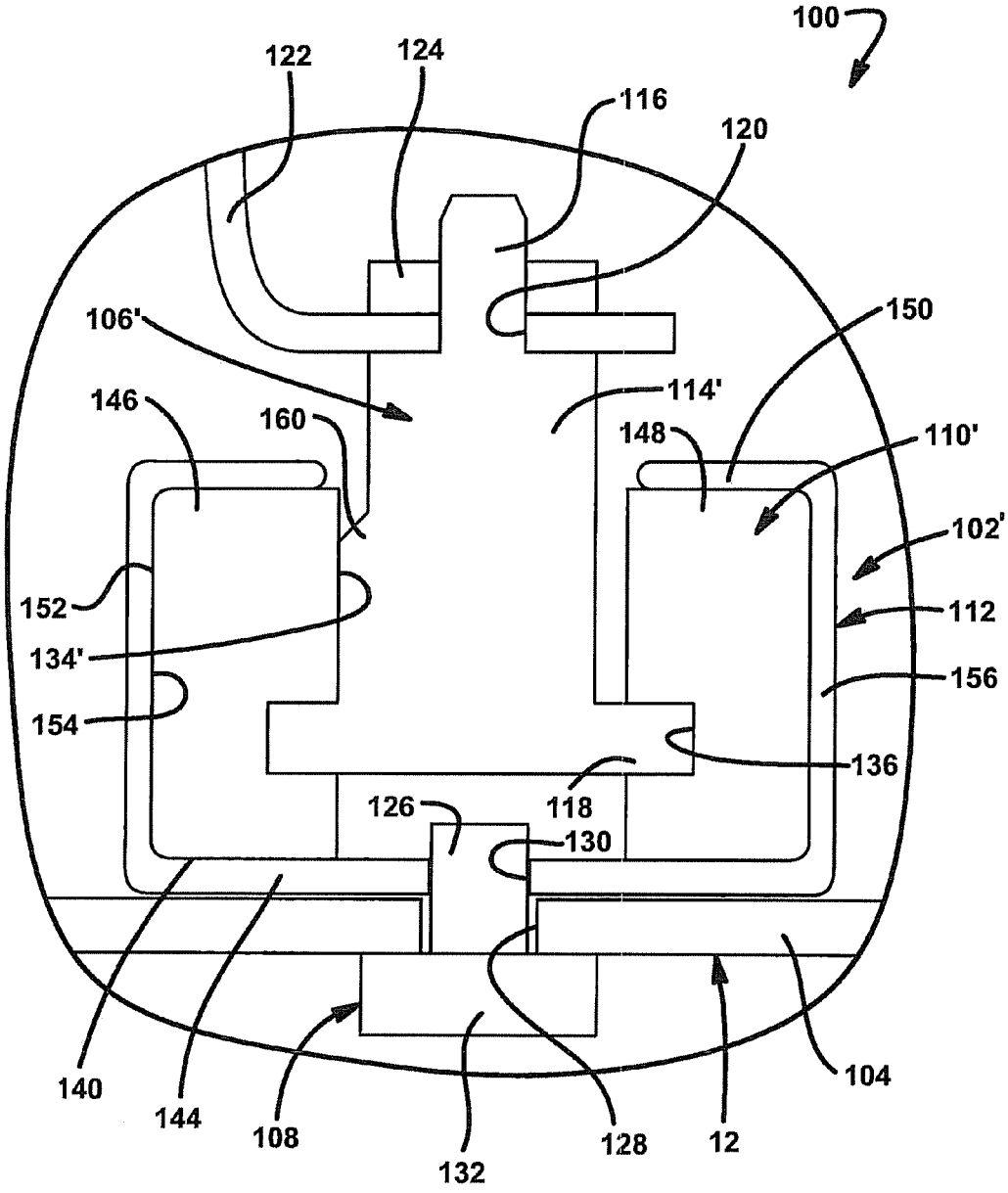
FIG. 6 is a sectional view, similar to FIG. 5, of an alternative construction for the isolation damper units of the present invention.

Referring now to FIG. 6, an alternative embodiment of an isolation damper assembly 102' is shown. In particular, shank segment 114' of first attachment component 106' now includes a plurality (only one shown) of radially outwardly extending tooth-shaped lobe projections 160, the terminal ends of which engage a cylindrical wall surface of aperture 134' in isolator 110'. Lobe projections 160 on shank segment 114' exert a radial compressive load on isolator 110' so as to provide the return-to-center function. Preferably, at least three equally-spaced lobe projections 160 extend outwardly from shank segment 114'. Thus, this arrangement is generally reverse to that shown in FIGS. 2 through 5 wherein lobes 138 on isolator 110 engage cylindrical shank segment 114 of first attachment component 106.

Those skilled in the art will understand that certain variations or alternative structures can be used in place of certain components described in association with isolation damper unit 102. For example, second attachment component 100 could be a threaded bolt rigidly secured (i.e., welded) to lower case segment 144 of casing 112 which is adapted to pass through mounting bore 128 in base section 104, and a nut that is tightened onto the threaded bolt so as to securely connect casing 112 of isolation damper unit 102 to base 12. As another alternative, casing 112 itself could be connected directly to base 12 using a rotary-type quick connector arrangement.

In the drawings and specification, there has been set forth preferred embodiments of the invention and, although specific terms are employed, these are used in a generic and descriptive sense only and not for purpose of limitation. Changes in the form and the proportions of parts, as well as in the substitution of equivalents, are contemplated as circumstances may suggest or render expedient without departing from the spirit or scope of the invention as further defined in the following claims.

What is claimed is:

1. A washing machine comprising: a cabinet having a base; a tub; a support frame connected to said tub; and a plurality of isolation damper units for resiliently coupling said support frame to said base of said cabinet, each of said isolation damper units having a casing adapted for connection to said cabinet base, an attachment component having a first segment adapted for connection to said support frame and a second segment extending into said casing, and an isolator retained in said casing and having an aperture engaging said second segment of said attachment component, wherein said casing includes a first case segment adapted for connection to said cabinet base, a second case segment and an outer rim segment interconnecting said first and second case segments to define an internal chamber within said casing, and wherein said isolator is retained within said chamber such that its aperture generally surrounds said second segment of said attachment component, wherein said isolator has a first end surface engaging said first case segment, a second end surface engaging said second case segment and an outer surface engaging said rim segment, whereby said first and second case segments cooperate to exert an axially directed compressive load on said isolator while said rim segment exerts a radially-directed compressive load on said isolator, wherein said second segment of said attachment component includes a plurality of outwardly extending projections adapted to engage said aperture in said isolator, and wherein said isolator is made of a resilient material such that said projections exert a compressive load on said isolator.

2. The washing machine of claim 1 wherein said isolator of said isolation damper unit is made of an elastomeric material.

3. The washing machine of claim 1 wherein said isolator of said isolation damper unit is made from microcellular polyurethane.

4. The washing machine of claim 1 wherein said aperture has a plurality of lobes which engage said second segment of said attachment component.

5. The washing machine of claim 1 wherein said isolator damper unit further includes a second attachment component for connecting said casing to said base of said cabinet.

6. The washing machine of claim 1 wherein said rim segment of said casing is cylindrical and said outer surface of said isolator is cylindrical.

7. A washing machine comprising: a cabinet; a tub assembly located within said cabinet and including an outer tub and a spin basket supported for rotation within said outer tub; a support frame mounted to said outer tub; a drive assembly operable for driving said spin basket; and a plurality of isolation damping units coupling said support frame to said cabinet, said isolation damping units each having a resilient isolator that inhibits rotation of said outer tub relative to said cabinet and biases said outer tub to a centered position within said cabinet wherein each of said isolation damping units further includes a casing adapted for connection to a base portion of said cabinet, and an attachment component having a first segment attached to said support frame and a second segment extending into a chamber formed in said casing, and wherein said isolator is disposed in said chamber and has an aperture engaging said second segment of said attachment component, wherein said casing includes a first case segment adapted for connection to said cabinet base, a second case segment and an outer rim segment interconnecting said first and second case segments to define said chamber within said casing, and wherein said isolator is retained within said chamber such that its aperture generally surrounds said second segment of said attachment component, wherein said isolator has a first end surface engaging said first case segment, a second end surface engaging said second case segment and an outer surface engaging said rim segment, whereby said first and second case segments cooperate to exert an axially directed compressive load on said isolator while said rim segment exerts a radially-directed compressive load on said isolator, wherein said second segment of said attachment component is a cylindrical shank segment, wherein said aperture in said isolator includes a plurality of inwardly extending lobes which engage said shank segment, and wherein said isolator is made of a resilient material such that said shank segment exerts a compressive load on said lobes of said isolator.

8. The washing machine of claim 7 wherein said isolator of said isolation damper unit is made of an elastomeric material.

9. The washing machine of claim 7 wherein said isolator of said isolation damper unit is made from microcellular polyurethane.

10. The washing machine of claim 7 wherein said rim segment of said casing is cylindrical and said outer surface of said isolator is cylindrical.

11. The washing machine of claim 7 wherein said outer surface of said isolator includes a series of contoured portions maintained in contact with said rim segment of said casing.

12. The washing machine of claim 11 wherein said isolator damper units further include a second attachment component for connecting said casing to said base of said cabinet.

* * * * *